United States Patent [19]

Borel

[11] Patent Number: 4,776,373

[45] Date of Patent: Oct. 11, 1988

[54] FABRIC FOR THE SHEET FORMING SECTION OF A PAPERMAKING MACHINE

[75] Inventor: Georg Borel, Reutlingen, Fed. Rep. of Germany

[73] Assignee: Hermann Wangner GmbH & Co., KG, Reutlingen, Fed. Rep. of Germany

[21] Appl. No.: 109,563

[22] Filed: Oct. 19, 1987

[30] Foreign Application Priority Data

Oct. 20, 1986 [DE] Fed. Rep. of Germany ..... 3635632

[51] Int. Cl.[4] ..... D03D 15/00

[52] U.S. Cl. ..... 139/383 A; 162/DIG. 1; 428/224

[58] Field of Search ..... 139/383 A, 425 A, 413; 162/DIG. 1, 348; 428/221, 224, 257

[56] References Cited

U.S. PATENT DOCUMENTS

| | | | |
|---|---|---|---|
| 4,071,050 | 1/1978 | Codorniu | 139/383 A |
| 4,086,941 | 5/1978 | Thompson | 139/383 A |
| 4,501,303 | 2/1985 | Osterberg | 139/383 A |
| 4,605,585 | 8/1986 | Johansson | 139/383 A |
| 4,709,732 | 12/1987 | Kinnunen | 139/383 A |

*Primary Examiner*—Henry S. Jaudon

*Attorney, Agent, or Firm*—Sughrue, Mion, Zinn, Macpeak, and Seas

[57] ABSTRACT

A fabric for the sheet forming section of a papermaking machine comprising two layers of transverse threads and longitudinal threads interwoven with both layers of transverse threads. Both the paper side and the running side have a transverse structure, and the number of transverse threads in the upper layer is twice as high as that in the lower layer. The longitudinal threads interweave twice in each repeat with the upper layer and with the lower layer. Interweaving with the upper layer is effected one time with a transverse thread laying directly above a transverse wire of the lower layer and the other time with a transverse thread disposed between and above two transverse threads of the lower layer. At the point of interweaving of the lower layer, two adjacent longitudinal threads are disposed side by side with one longitudinal thread interweaving, at one point of interweaving, together with the preceding longitudinal thread and, at the next point of interweaving, together with the next following longitudinal thread.

5 Claims, 2 Drawing Sheets

FABRIC FOR THE SHEET FORMING SECTION OF A PAPERMAKING MACHINE

BACKGROUND OF THE INVENTION

The invention relates to a fabric for the sheet forming section of a papermaking machine, e.g. a so-called sheet former. The fabric consists of a double-layer fabric, i.e. two layers of transverse threads are provided, and the longitudinal threads interweave with each of the two layers of transverse threads. Both on the running side and on the paper side, the transverse threads are predominantly visible. In each repeat, the longitudinal threads interweave twice with the upper layer of the transverse threads. On the paper side the transverse threads overly at least 80% of the longitudinal threads. The fact that the number of transverse threads on the running side is only half that on the paper side is compensated by the greater diameter of the transverse threads of the lower layer.

In the sheet forming fabric disclosed in German Patent Publication No. 2,706,235 of 9-8-1977 (FIG. 2F), the longitudinal threads have a relatively flat course, despite two points of interweaving with the upper layer in the interior of the fabric, with the consequence that the woven seam by which two fabric ends of flat woven fabrics are joined to form an endless fabric, has a relatively low strength. Moreover, cleaning with high pressure water jets from the running side soon destroys the woven seam. The locations where the longitudinal and warp threads meet within the woven seam are distributed at random within the woven seam. The warp thread ends lie exposed side by side at the meeting points, i.e. each meeting point is an interruption of the warp thread, so that the transverse or weft thread of the lower layer is not held at the meeting point of the warp thread ends and is more intensely worn over a width corresponding to two weave repeats. The unwoven free warp thread ends are shredded and destroyed very soon when the papermachine fabric is cleaned with high pressure water jets.

In European Patent Publication No. 30 490 of 6-17-81, a double-layer sheet forming fabric is disclosed in which the longitudinal threads interweave twice per each repeat with the upper layer of transverse threads, but only once with the lower layer of transverse threads. This sheet forming fabric has the same number of transverse threads in the upper and in the lower layer so that the two points if interweaving with the upper layer of transverse threads shorten the transverse thread floats on the paper side. As a consequence, it is difficult to remove the paper web from the sheet forming fabric.

A similar sheet forming fabric is disclosed in German Patent Publication No. 2,263,476 of 3-7-74, where the longitudinal threads are interwoven two or three times into the upper layer. In the lower layer, the longitudinal threads extend under two or three transverse threads, so that they are subject to high wear. According to German Patent Publication No. 2,540,490 of 4-22-76, this is remedied in that each longitudinal thread interweaves at the most with every sixth transverse thread in the lower layer. However, there still remains the disadvantage of low dehydration capacity and difficulties in removing the sheet, especially in the manufacture of tissue paper.

In the manufacture of paper on twin wire paper machines, it is a nuisance that the interior of the papermachine fabric fills with water flowing through, and at the point of deflection of the fabric, said water is forced out of the interstices of the lower layer. Due to the high speeds of 1500 to 1800 m/min at which the twin wire formers are operated, the issuing water forms a dense mist at the first fabric deflection point.

In U.S. Pat. No. 4,564,042, a double layer sheet former for a papermaking machine is disclosed wherein the longitudinal threads are interwoven with the lower layer twice in each repeat, the first time together with the preceding longitudinal thread, and the next time together with the next following longitudinal thread, the longitudinal thread extending between two points of interweaving over at least one transverse thread of the lower layer. This mode of interweaving is to ensure that the sheet forming fabric is a transverse thread runner and accordingly has a longer service life.

SUMMARY OF THE INVENTION

The present invention is concerned with the problem of providing a fabric for the sheet forming section of a papermaking machine which exhibits an improved combination of retention, drainage capacity, and sheet removal.

Proceeding from a fabric of the initially described type, this problem is solved in that the longitudinal threads interweave twice in each repeat with the lower layer, and that at each point of the interweaving two adjacent longitudinal threads lie side by side, and at one point of interweaving one longitudinal thread interweaves together with the preceding longitudinal thread and at the next point of interweaving together with the next following longitudinal thread, and each longitudinal thread passes over at least one transverse thread of the lower layer between two points of interweaving. Compared with a sheet forming fabric having an equal number of transverse threads in the upper and the lower layers, in the sheet forming fabric of the present invention, the float length of the upper transverse threads is not shortened by repeated interweaving with the longitudinal threads. Due to two points of interweaving of the longitudinal threads with the upper layer, the surface of the fabric becomes denser, but surprisingly the permeability does not decrease, but even increases. This seems to be due to the fact that the paper side consists of a great number of transverse threads, and each transverse thread of the upper layer interweaves only once per repeat with a longitudinal thread. Hence, the transverse thread floats remain highly overmonoplanar relative to the longitudinal thread knuckles. The term "overmonoplanar" is derived from the fact that in a flat woven fabric, the transverse threads (weft) at first lie straight in the fabric, and the knuckles of the longitudinal threads (warp) project on both sides of the fabric. During thermosetting of the fabric high tension is exerted on the longitudinal threads so that they tend to straighten. In so doing, they deform the transverse threads and crimp them, which is known as crimp interchange. Frequently, sheet forming fabrics are thermoset at such longitudinal tension that the topmost points of the longitudinal threads and of the transverse threads are disposed in a single plane and the fabric is then monoplanar. If thermosetting is continued beyond this point, the crimp of the longitudinal threads decreases and that of the transverse threads increases, i.e., the transverse threads project on the paper side and, depending on the construction of the fabric, also on the backing side. The sheet forming fabric is then overmonoplanar on the paper side, and the fiber web is supported by the transverse threads (transverse thread supporter or weft supporter). In endless woven forming fabrics, thermosetting cannot effect monoplanicity or overmonoplanicty, because there the longitudinal threads are formed by the weft so that they are already disposed straight in the fabric owing to the weaving operation. The pronounced transverse structure on the paper side of the fabric of the invention, in combination with the overmonoplanicity, offers good support for the forming paper sheet, and at the same time, facilitates the removal of the paper sheet from the sheet forming fabric. This is significant particularly in case of very thin tissue paper of low tensile strength. It is equally significant in the manufacture of tissue paper that the fabric is highly permeable. At operating speeds of the papermaking machine in the order of 1500 to 1800 m/min and with a high degree of dilution of the paper pulp, large quantities of water must be discharged through the fabric over short dehydration paths and within extremely short time periods, especially in the manufacture of tissue paper.

The fabric of the present invention is especially well suited for use on twin wire paper machines. It has been found that with the papermachine fabric of the present invention, the above mentioned discharge of water from the fabric at the first points of fabric deflection is substantially decreased. It has not been clarified why this is so. With prior art fabrics, where each longitudinal thread interweaves with the lower layer only once in each repeat, the lower half of the fabric is formed nearly exclusively of isolated transverse thread knuckles, since after one interweaving step the longitudinal threads return obliquely upwardly to the paper side.

Actually, one would have expected a fabric having a very loose structure (German Patent Publication No. 2,706,235, FIG. 2F) to let the water freely flow through the fabric, rather than retain it. A fabric with denser interlacing of the threads on the running side, like in the papermachine fabric of the present invention, should be expected to retain more water in the fabric. Surprisingly, however, this is not so. Possibly this is due to the fact that the longitudinal threads largely remain on the running side. This reduces the interstices between the transverse threads on the running side. By pair-wise arrangement of the longitudinal threads at the points of interweaving, the otherwise very open running side is partially sealed so that the entrainment of water and the later discharge at the points of deflection, is substantially reduced. Nevertheless, the fabric still is a transverse thread runner on the running side. The floats of transverse threads between the points of interweaving with the longitudinal threads are very long on the running side, and at the points of interweaving, two longitudinal threads each with joint longitudinal tension, act on the transverse threads and crimp them.

Owing to its high dehydrating capacity, the papermachine fabric of the invention is suited especially for the manufacture of fine tissue paper types on twin wire paper machines.

The sheet forming fabric of the present invention is also suited for the manufacture of writing and printing paper types, as it permits extremely high numbers of transverse threads in the upper layer, while being still sufficiently permeable, which improves the retention of the paper pulp and marking. Owing to the improved retention, the sheet forming fabric is suited also for manufacturing so-called "brown" paper types, i.e. kraft paper, packaging paper based on recycle materal, and for cardboard. Preferably, the weave is a 7-, 8-, 14-, or 18-harnesss weave, based on the transverse threads in the lower layer.

The transverse threads in the lower layers suitably have greater diameter. The diameter of said transverse threads is selected only so wide that the longitudinal threads are still able to sufficiently crimp said transverse threads and that in this way the longitudinal threads are hardly exposed to wear. This crimping occurs only when the fabric is set so that the setting tension must be selected accordingly in order to impart to the sheet forming fabric the characteristic of a transverse thread runner.

Suitably, the fabric of the invention is woven flat so that the transverse threads become the weft threads and the longitudinal threads function as warp threads. The manufacture of a transverse thread runner by endless weaving meets with additional problems, but it is possible. However, this requires looms with a very high number of harnesses or a thread divider according to German Patent Publication No. 3,108,189.

The transverse threads of the upper and lower layer and the longitudinal threads are suitably synthetic resin monofilament, especially polyester monofilament. The transverse threads of the lower layer and optionally of the upper layer may also consist partially of polyamide.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
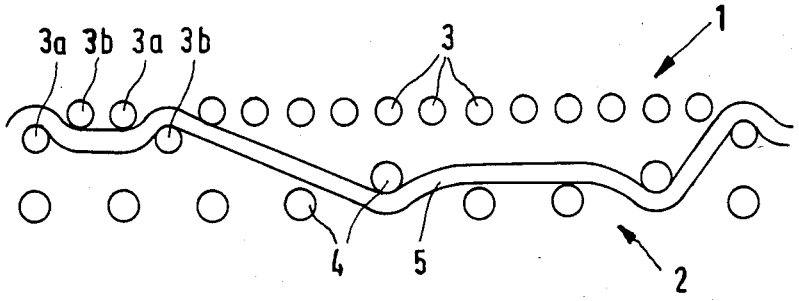
FIG. 1 schematically illustrates the course of a longitudinal thread.
Figure 4:
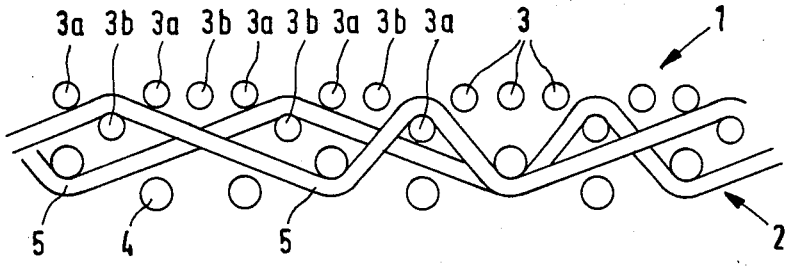
FIG. 4 shows the course of a pair of longitudinal threads in another example.

According to FIG. 1, the example comprises an upper layer 1 of transverse threads 3 and a lower layer 2 of transverse threads 4. The number of transverse threads in the upper layer 1 is twice that in the lower layer 2, so that in the upper layer 1, each transverse thread 39 is disposed above a transverse thread 4 of the lower layer 2, and each adjacent transverse thread **3*b* is disposed midway above two transverse threads 4 of the lower layer 2**.

Longitudinal threads 5 connect the upper layer 1 and the lower layer 2. FIG. 1 shows the course of a longitudinal thread 5 within one weave repeat. The weave repeat extends over sixteen transverse threads 3 of the upper layer and eight transverse threads 4 of the lower layer. Commencing at the left-hand margin of the figure, the longitudinal thread 5 passes over a transverse thread **3*a* of the upper layer 1, then under two transverse threads 3*b* and 3*a* of the upper layer 1, over one transverse thread 3*b* of the upper layer 1, then interweaves with the fifth transverse thread 4 of the lower layer 2, passes between the two layers 1, 2, interweaves with the eighth transverse thread 4 of the lower layer 2, and finally rises obliquely upwards in order to again interweave with the first transverse thread 3*a* in the upper layer 2** in the next following weave repeat.

Each longitudinal thread 5 thus interweaves within one weave repeat with a transverse thread 3*a* disposed above a transverse thread 4 of the lower layer 2, and with a transverse thread 3*b* disposed midway above two transverse threads 4 of the lower layer. Between the two transverse threads 3*a* and 3*b* of the upper layer with which the longitudinal thread 5 interweaves two, four or another even number of transverse threads must be disposed in order to answer the requirement that each longitudinal thread interweaves within one repeat with a transverse thread 3*a* disposed above one transverse thread 4 of the lower layer 2, and with a transverse thread 3*b* disposed midway above two transverse threads 4 of the lower layer 2.

Figure 2:
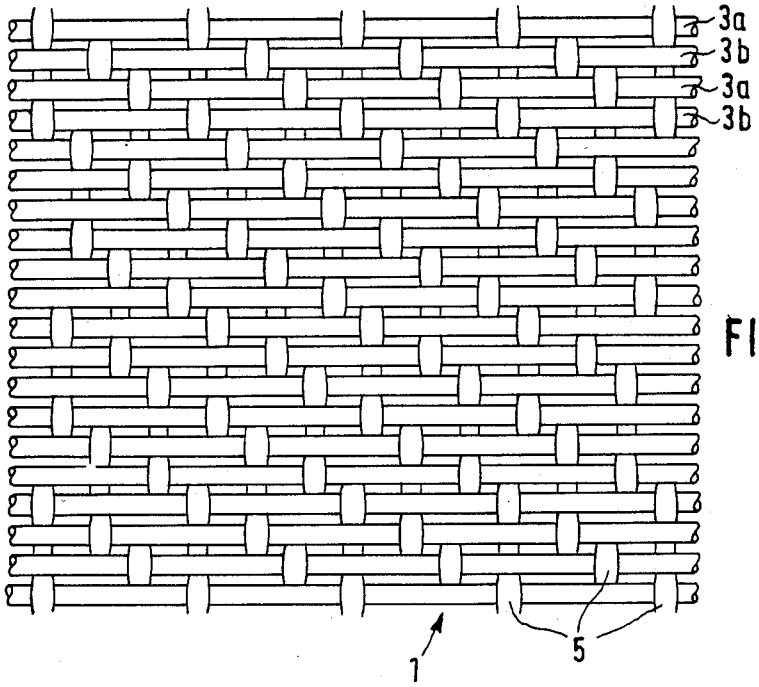
FIG. 2 is a plan view of the paper side of the fabric.

The weave pattern on the paper side is shown in FIG. 2. It is discernible that adjacent longitudinal threads 5 are each mutually offset by six transverse threads in the longitudinal direction, and each weave repeat comprises eight longitudinal threads 5.

Figure 3:
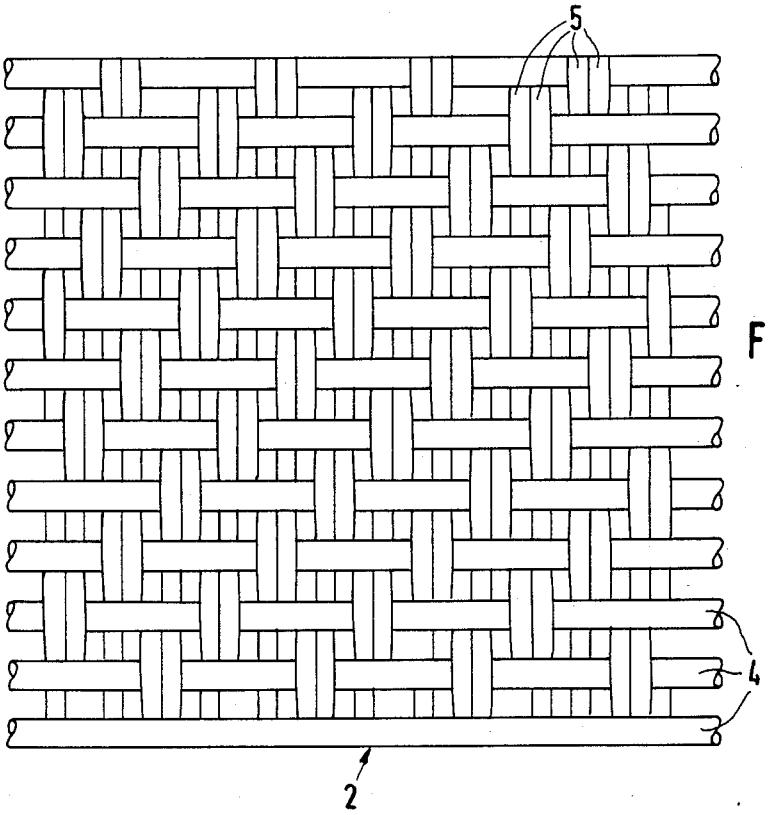
FIG. 3 is a plan view of the running side.

FIG. 3 is a bottom view of the running side of the example shown in FIGS. 1 and 2. At each point of interweaving, two longitudinal threads 5 lie side by side and jointly interweave with a transverse thread 4 in the lower layer 2. At one point of interweaving, the threads interweave with the next left-hand longitudinal thread 5 and at the next point disposed further above in FIG. 3 they interweave with the next right-hand longitudinal thread.

In FIGS. 2 and 3 it is discernible that both on the paper side and on the running side, there is a pronounced transverse structure which is prerequisite for a transverse thread carrier and transverse thread runner.

In the example illustrated by FIGS. 1 to 3, the two points of interweaving of the longitudinal thread 5 into the upper layer 1 directly follow each other, i.e. without any intermediate interweaving of the longitudinal thread 5 with the lower layer 2. In the same way, the two points of interweaving of the longitudinal thread 5 with the lower layer 2 directly follow each other.

EXAMPLE

The fabric has the eight-harness weave shown in FIGS. 1 to 3 and is woven flat. The longitudinal threads 5 consist of polyester monofilament of 0.15 mm diameter and are arranged in a density of 68 filaments/cm. The transverse threads 3 of the upper layer 1 consist of polyester monofilament of 0.14 mm diameter and are arranged in a density of 42 filaments/cm. The transverse threads 4 of the lower layer 2 consist alternately of polyester monofilament and polyamide-6, 6 monofilament of 0.18 mm diameter and are arranged in a density of 21 filaments/cm.

The following data applies to the finally set fabric. Setting is carried out at a temperature of about 200° C. and at a tension such that the longitudinal thread 5 is displaced toward the fabric interior both on the paper side and on the running side so that it is not exposed to wear on the running side and does not interfere with the removal of the sheet on the paper side. During setting the fabric elongates by about 8%. The crimp height of the longitudinal threads 5 decreases, and the longitudinal threads are displaced into the fabric interior. The transverse threads 3 and 4 are crimped by the tension exerted by the longitudinal threads 5 whereby the width of the fabric decreases by about 11%. Due to transverse contraction and the pressure and tension of the longitudinal threads 5, the transverse threads 3,4 bend outwardly along the long floats and form the desired overmonoplanar structure on the paper side and on the running side.

While the invention has been particularly shown and described with reference to preferred embodiments thereof, it will be understood by those in the art that the foregoing and other changes in form and details may be made therein without departing from the spirit and scope of the invention.

What is claimed is:

1. A fabric for the sheet forming section of a papermaking machine comprising two layers of transverse threads and longitudinal threads interwoven with both layers of transverse threads in which both on the paper side and on the running side, the transverse threads are predominantly visible and the number of transverse threads in the upper layer is twice the number of transverse threads in the lower layer, wherein the longitudinal threads are interwoven into the upper layer twice in each repeat, one time with a transverse thread disposed above a transverse thread of the lower layer and the other time with a transverse thread disposed between and above two transverse threads of the lower layer, and between the two points of interweaving the longitudinal thread extends under at least two transverse threads of the upper layer and wherein the longitudinal threads are interwoven twice per repeat into the lower layer of transverse threads, and each time the interweaving is performed by two adjacent longitudinal threads, one longitudinal thread interweaving at a point of interweaving together with the preceding longitudinal thread and at the next following point of interweaving together with the following longitudinal thread, and the longitudinal thread extends between the two points of interweaving over at least one transverse thread of the lower layer.

2. A fabric according to claim 1, wherein the upper layer has a 7-, 8-, 14-, or 16-harness weave.

3. A fabric according to claim 1, wherein the transverse threads of the upper and lower layers project relative to the longitudinal threads on the paper side and on the running side respectively, so that wear primarily concentrates on the transverse threads in the lower layer, and the paper sheet is primarily carried by the transverse threads in the upper layer.

4. A fabric according to claim 1, wherein the two points of interweaving with the upper layer and with the lower layer directly follow each other, without the longitudinal thread interweaving with the respective other fabric layer in-between the two points of interweaving.

5. A fabric according to claim 1, wherein each interweaving of a longitudinal thread with one of the two layers is followed by interweaving with the respective other layer.

* * * * *